US010472886B2

(12) United States Patent
Nelson

(10) Patent No.: US 10,472,886 B2
(45) Date of Patent: Nov. 12, 2019

(54) MICRO GAP ROLLER SHADE SYSTEM AND METHOD OF INSTALLATION

(71) Applicant: James A. Nelson, La Palma, CA (US)

(72) Inventor: James A. Nelson, La Palma, CA (US)

( * ) Notice: Subject to any disclaimer, the term of this patent is extended or adjusted under 35 U.S.C. 154(b) by 194 days.

(21) Appl. No.: 15/721,515

(22) Filed: Sep. 29, 2017

(65) Prior Publication Data

US 2018/0283096 A1 Oct. 4, 2018

Related U.S. Application Data

(60) Provisional application No. 62/601,739, filed on Mar. 29, 2017, provisional application No. 62/605,828, filed on Aug. 29, 2017.

(51) Int. Cl.

| | |
|---|---|
| ***E06B 9/42*** | (2006.01) |
| ***E06B 9/44*** | (2006.01) |
| ***E06B 9/72*** | (2006.01) |

(52) U.S. Cl.
CPC . *E06B 9/44* (2013.01); *E06B 9/72* (2013.01)

(58) Field of Classification Search
CPC ..... E06B 9/72; E06B 9/74; E06B 9/50; E06B 2009/3227; E06B 2009/1713; E06B 9/44; E06B 9/42; E06B 2009/402; E06B 2009/407
USPC ..... 160/310
See application file for complete search history.

(56) References Cited

U.S. PATENT DOCUMENTS

| | | | | |
|---|---|---|---|---|
| 1,170,068 | A * | 2/1916 | Hoyt | E06B 9/44 160/263 |
| 1,233,884 | A * | 7/1917 | Kraemer et al. | E06B 9/44 160/100 |
| 3,315,728 | A * | 4/1967 | Anderson | E06B 9/44 160/326 |
| 6,497,267 | B1 * | 12/2002 | Azar | E06B 9/42 160/188 |
| 2004/0226669 | A1 * | 11/2004 | Webb | E06B 9/44 160/299 |
| 2006/0054288 | A1 * | 3/2006 | Bibby | E06B 9/44 160/313 |

(Continued)

OTHER PUBLICATIONS

Written Opinion of the International Searching Authority for PCT/US2018/053527 dated Jan. 8, 2019.

*Primary Examiner* — Daniel P Cahn
(74) *Attorney, Agent, or Firm* — Cotman IP Law Group, APLC

(57) ABSTRACT

The invention is a roller shade tube assembly with a main housing having a lumen divided into two sections by an internal spring stop. The distal end of the main housing has a recessed mounting cavity coupleable to a motor. The proximal end of the main housing has one or more interlocking fingers. A spring inside the proximal lumen abuts the spring stop. An inner guide cylinder is coupled to slide inside the main housing against the spring and coupled to a lumen of an auxiliary housing that is movably coupled to the main housing. The distal end of the auxiliary housing includes one or more complementary interlocking fingers and a second recessed mounting cavity at its proximal end. Wall mounting brackets on each side of the tube assembly are configured to fit into the recessed mounting cavities. A shade fabric is coupled to the roller shade tube assembly.

17 Claims, 7 Drawing Sheets

(56) References Cited

U.S. PATENT DOCUMENTS

| | | | | |
|---|---|---|---|---|
| 2008/0230185 | A1* | 9/2008 | Kahn | E06B 9/44 160/23.1 |
| 2011/0203754 | A1 | 8/2011 | Muller et al. | |
| 2014/0069595 | A1 | 3/2014 | Chen | |
| 2016/0369558 | A1 | 12/2016 | Kirby | |
| 2018/0087269 | A1* | 3/2018 | Hall | E04B 2/7403 |
| 2018/0283096 | A1 | 4/2018 | Nelson | |
| 2018/0202225 | A1* | 7/2018 | Lagarde | E06B 9/174 |
| 2018/0209214 | A1* | 7/2018 | Geiger | E06B 9/72 |
| 2018/0291682 | A1* | 10/2018 | Walter-Seifart | E04F 10/0648 |
| 2019/0055781 | A1* | 2/2019 | Cheng | E06B 9/44 |
| 2019/0136617 | A1* | 5/2019 | Kao | E06B 9/60 |

* cited by examiner

MICRO GAP ROLLER SHADE SYSTEM AND METHOD OF INSTALLATION

CROSS-REFERENCE TO RELATED APPLICATIONS

The present application claims the benefit of U.S. Provisional Application Ser. No. 62/601,739, filed on Mar. 29, 2017, also claims the benefit of U.S. Provisional Application Ser. No. 62/605,828, filed on Aug. 29, 2017, specifications of which are herein incorporated by reference for completeness of disclosure.

BACKGROUND OF THE INVENTION

Field of the Invention

Embodiments of the invention relates to roller shade systems. More specifically, the invention relates to a roller shade system with micro gaps.

Description of the Related Art

Current roller shade systems use fixed tubes that need to be cut to precise length, sometime at the installation site, to fit the width of the window wherein it is to be installed. After cutting and installation, there is a large and very noticeable gap between the shade and window frame thereby letting in light where none is desired and not providing adequate privacy. The gap is partly because the shade tube has to fit between the bulky brackets. Thus, the bulky wall mounting brackets are in plain sight and reduces the aesthetics of the installation.

To overcome the problems and limitations described above there is a need for a micro gap roller shade system of the present invention.

BRIEF SUMMARY OF THE INVENTION

One or more embodiments of the invention are directed to an apparatus for a micro gap roller shade system and method of installation. The system comprises a roller shade tube assembly with a tubular main housing. The tubular main housing includes a first lumen at a proximal end and a second lumen at its distal end. The first lumen and the second lumen are separated by an internal spring stop. The spring stop could be an internal flange, for example.

In one or more embodiments, the distal end of the main housing comprises a first recessed mounting cavity and the proximal end comprises a first side of one or more interlocking fingers. In a preferred embodiment, the first recessed mounting cavity is concave.

In one or more embodiments, a spring is located inside the proximal lumen of the main housing, with the spring stop acting to prevent the spring from sliding in the lumen. In one or more embodiments, the spring is a compression spring.

One or more embodiments of the invention further comprises a tubular auxiliary housing with a first lumen at a distal end. The lumen is configured to hold an inner guide cylinder that is fixedly coupled to the inside the distal lumen of the auxiliary housing. The inner guide cylinder is configured to abut the spring and to slide inside the main housing.

The distal end of the auxiliary housing comprises a second side of the one or more interlocking fingers. The second side of the one or more interlocking fingers of the auxiliary housing engage with the first side of the one or more interlocking fingers of the main housing to create an assembly that can compress but is restricted from twisting. The proximal end of the auxiliary housing comprises a second recessed mounting cavity. In a preferred embodiment, the second recessed mounting cavity is concave.

One or more embodiments of the invention further comprises a main side bracket configured for mounting onto a window frame and to fit into the first recessed mounting cavity. In configurations with an electric motor, the main side mounting bracket is further configured to couple to the motor located in the distal lumen of the main housing. In configurations where the motor is electrical, the main side bracket is configured to couple power to the motor.

One or more embodiments of the invention further comprises an auxiliary side bracket configured to fit into the second recessed mounting cavity and for mounting onto a window frame.

One or more embodiments of the invention further comprises a shade fabric coupled to the roller shade tube assembly. The shade fabric may be coupled to the roller shade assembly with a sleeve configured for mounting the fabric to the roller shade tube assembly.

In one or more embodiments, the length of the one or more interlocking fingers define a compression travel range between the main housing and the auxiliary housing.

In one or more embodiments, the main housing and the auxiliary housing include an extrusion from the distal end of the main housing to the proximal end of the auxiliary housing. The extrusion allows for using the sleeve to mount or couple the fabric to the roller tube assembly.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

Figure 1:
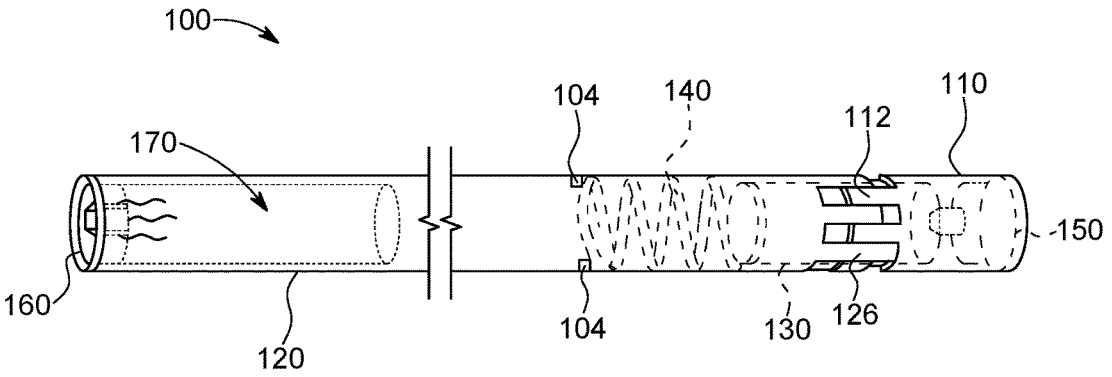
FIG. 1 is an isometric view of a micro gap control roller shade tube assembly from the motor side in accordance with one or more embodiments of the present invention.

The present invention comprising a micro gap roller shade system and method of installation will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. It should be noted that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

One or more embodiments of the present invention will now be described with references to FIGS. 1-7.

Figure 2:
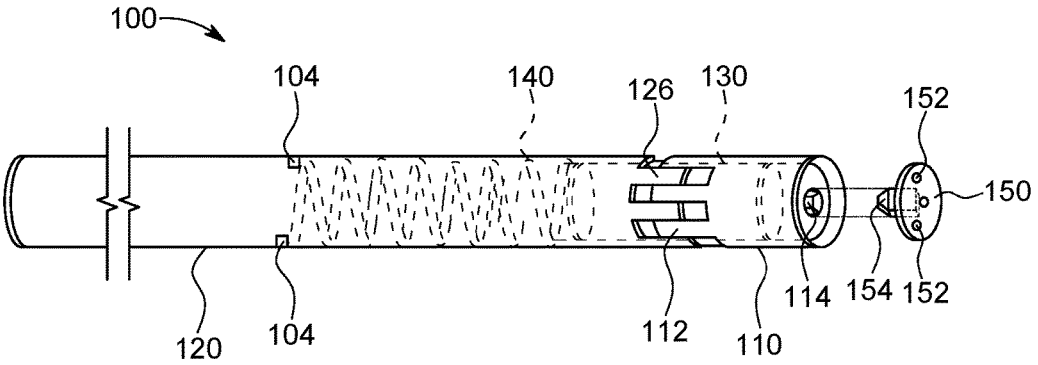
FIG. 2 is an isometric view of the micro gap control roller shade tube assembly from the non-motor side in accordance with one or more embodiments of the present invention.
Figure 3:
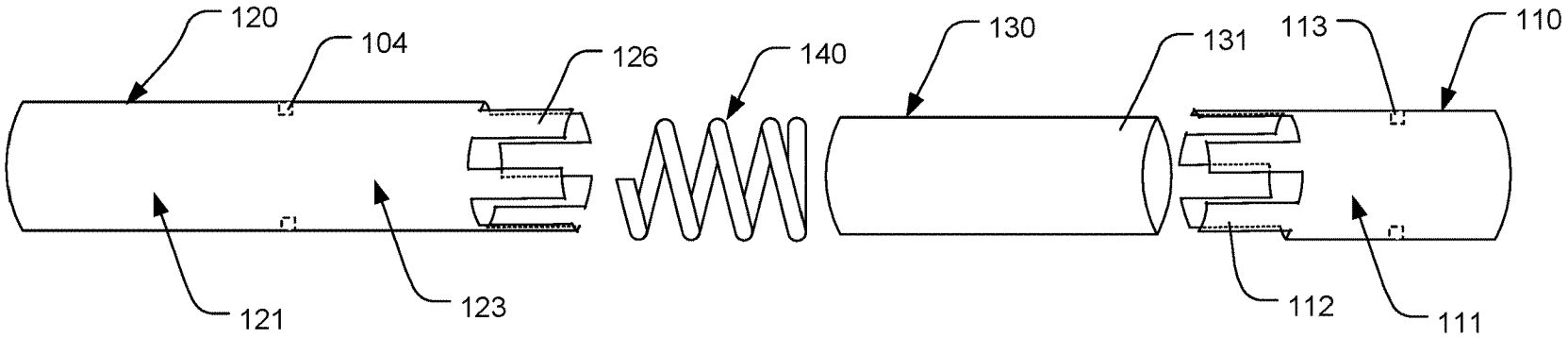
FIG. 3 is an exploded view showing the essential elements of the micro gap control roller shade tube assembly in accordance with one or more embodiments of the present invention.

As illustrated, in FIGS. 1-3, the micro gap tube apparatus 100 of an embodiment of the present invention comprises a main tube 120; a spring 140 inside a lumen in the main tube 120 abutting a spring stop; an inner guide cylinder 130 abutting the spring 140; an auxiliary tube 110 coupled to the inner guide cylinder 130; a motor side bracket 160 coupleable to the main tube 120; and an auxiliary side bracket 150 coupleable to the auxiliary tube 110.

Figure 4A:
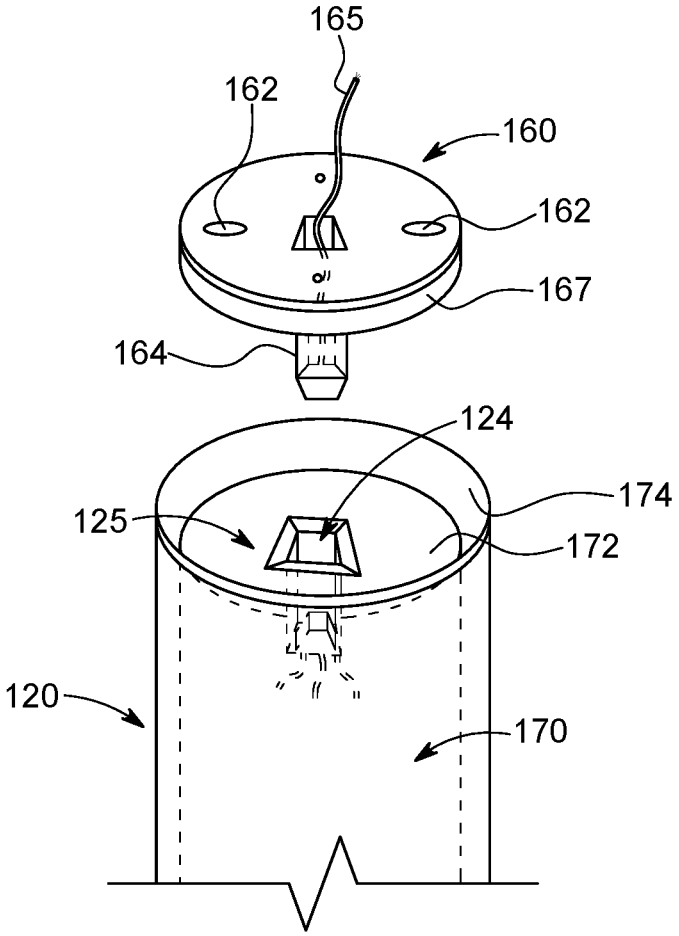
FIG. 4A is a close-up illustration of the motor side of the micro gap control roller shade tube assembly in accordance with one or more embodiments of the present invention.
Figure 4B:
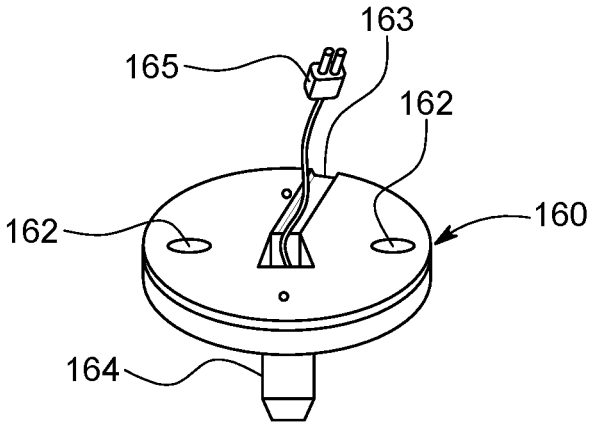
FIG. 4B is a close-up illustration of another embodiment of the wall bracket of the motor side of the micro gap control roller shade tube assembly.
Figure 5:
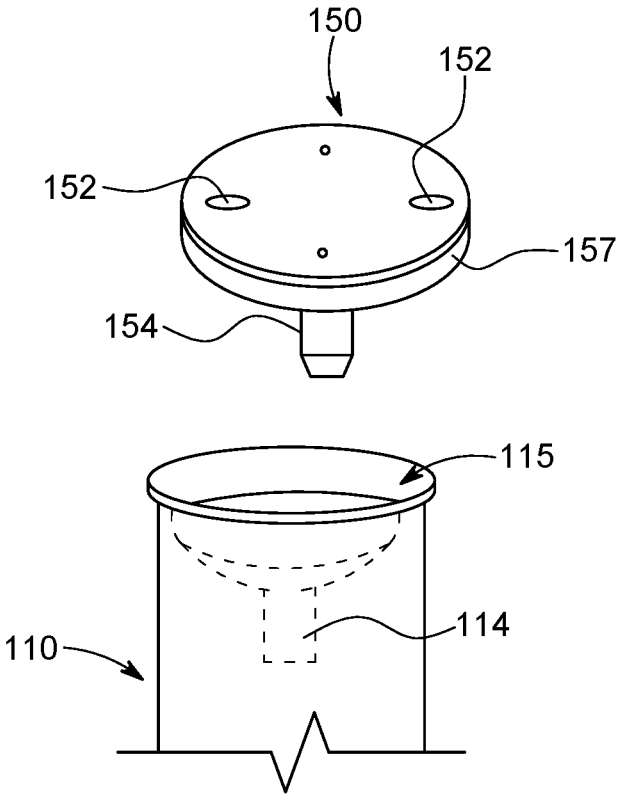
FIG. 5 is a close-up illustration of the non-motor side of the micro gap control roller shade tube assembly in accordance with one or more embodiments of the present invention.

In one or more embodiments, main tube 120 is configured to house an optional motor 170 in a lumen, e.g. 121, near the distal end of the main tube (FIG. 1). As illustrated in FIG. 4A, motor 170 comprises a fixed section 172 and a rotating section (or flange) 174. The rotating section 174 is coupled to the main tube 120 and configured to rotate the main tube 120 with rotation of the motor shaft.

Figure 7:
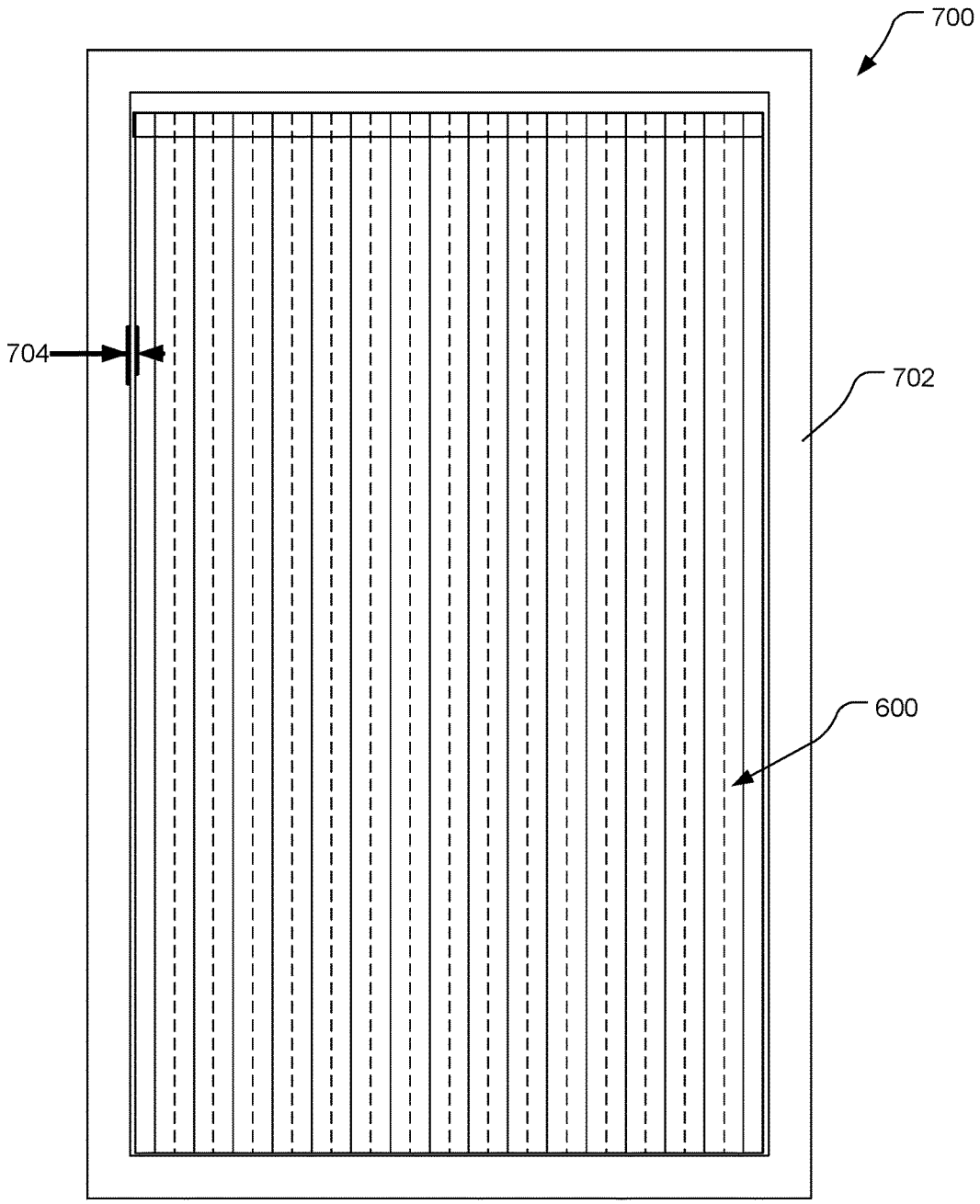
FIG. 7 is an illustration of the micro gap roller shade system mounted on a window frame in accordance with one or more embodiments of the present invention.

In one or more embodiments, motor side bracket 160 is configured to be coupled to a window frame, e.g. 702 in FIG. 7, and also to couple power to the motor 170. Motor 170 is preferably an electric motor. Motor 170 may also be a spring-lift type mechanism. Those of skill in the art would appreciate that motor 170 may be an AC or a DC motor, depending on the environment or as desired. Electrical cord 165 provides power to motor 170. The power source may be an AC outlet or a battery pack. In embodiments employing battery packs, the battery pack is preferably mounted within reach of a person standing on the floor so that it could easily be serviced (e.g. replaced) without needing to climb a ladder, for example.

In one or more embodiments, motor side bracket 160 comprises a recessed mounting bracket that is coupled to the window frame 702 via one or more holes 162 using screws (not shown). Bracket 160 is configured such that its entire profile substantially resides in and couples with a recessed cavity, e.g. 125, in main tube 120 (see FIG. 4A). In a preferred embodiment, the motor side bracket 160 comprises a convex body 167 that fits substantially into concave receptacle (or cavity) 125 such that the distal end of main tube 120 can slide into the wall-mounted bracket with minimal effort during installation.

In one or more embodiments, motor side bracket 160 couples to motor 170 via mating of plug 164 and socket 124. In the illustration of FIG. 4A, the motor side bracket 160 is configured such that the electrical cord 165 is routed through a hole in the wall of the window frame 702. In another embodiment, illustrated in FIG. 4B, the motor side bracket 160 is configured with a groove 163 for electrical cord 165. In this configuration, electrical cord 165 is routed outside of the window frame 702 to the power source.

In one or more embodiments, main tube 120 comprises a lumen 123 at its proximal side that is configured to house a spring 140. Main tube 120 further comprises an internal flange or similar device 104 between the proximal side lumen 123 and the distal side lumen 121 that is configured as a spring stop for spring 140. Those of skill in the art would appreciate that the spring stop could have other configurations not described herein, i.e. other than a flange, so long as the function of providing a stop for spring 140 is achieved. Spring 140 is preferable a compression spring.

In one or more embodiments, the proximal end of main tube 120 comprises a first side 126 of one or more interlocking fingers.

In one or more embodiments, the micro gap tube apparatus 100 further comprises an auxiliary tube 110 movably coupled to the main tube 120. The auxiliary tube 110 comprises a lumen, e.g. 111, in which the proximal end, e.g. 131, of inner guide cylinder 130 is to fixedly coupled. The inner guide cylinder 130 may be coupled to auxiliary tube 110 at station 113, for example, using glue, screws, etc. Those of skill in the art would appreciate that the particular means by which the inner guide cylinder 130 is coupled to auxiliary tube 110 is not critical to the invention.

In one or more embodiments, the distal end of auxiliary tube 110 comprises a second side 112 of the one or more interlocking fingers. Interlocking fingers 112 are complementary to interlocking fingers 126 of main tube 120 such that when the main and auxiliary tubes are coupled together (FIG. 1), the fingers interlock in a precise fit thereby preventing rotational free-play between the main tube and the auxiliary tube. The coupling of the interlocking fingers allows the tube assembly 100 to rotate as one unit, e.g. with operation of the motor. Those of skill in the art would appreciate that the number of the fingers on the main tube and the auxiliary tube required to form the interlocking fingers could be one or more. The length of the interlocking fingers provide the extent of compression available for the micro gap tube assembly 100.

In one or more embodiments, auxiliary side bracket 150 is configured to be coupled to the opposing side of the window frame 702. Auxiliary side bracket 150 is a recessed mounting bracket that is coupled to the window frame 702 via one or more holes 152 using screws (not shown). Bracket 150 is configured such that it mounts and resides substantially in a recessed cavity, e.g. 115, at the proximal end of auxiliary tube 110 (see FIG. 5). Auxiliary side bracket 150 couples to recessed cavity 115 with female receiver end cap 116 at the proximal end of auxiliary tube 110. In a preferred embodiment, the auxiliary side bracket 150 comprises a convex body 157 that fits substantially into concave receptacle (or cavity) 115 such that the proximal end of auxiliary tube 110 can slide into the wall-mounted bracket with minimal effort during installation.

In one or more embodiments, the female receiver end cap 116 is made of nylon type material to allow for free rotation of the roller shade tube on the bracket. In such configuration, the male end 154 and the hole 114 are cylindrical. Those of skill in the art would appreciate that the female receiver end cap 116 may be made of other types of materials so long as it allows for free rotational motion of the roller shade tube. For instance, the female receiver end cap 116 or the male end 154 may include bearings or similar type structure that would allow free rotation of the roller shade tube assembly 100.

Those of skill in the art would appreciate that, although the roller shade tube assembly 100 have been described with the motor and the spring in the main tube and the inner guide cylinder fixedly coupled to the auxiliary tube, other arrangements are contemplated. For instance, the spring could be in the auxiliary tube instead of the main tube and the inner guide cylinder fixedly coupled to the main tube. Thus, the arrangement is insignificant so long as it is configured to allow for compression of the roller shade assembly during installation.

Figure 6A:
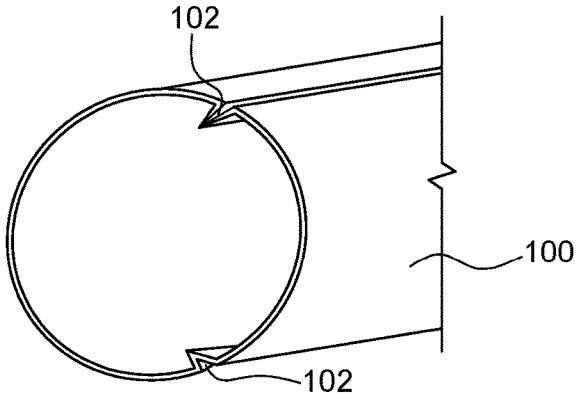
FIG. 6A is a close-up illustration of the outside perimeter of the micro gap control roller shade tube assembly showing extrusions for a fabric mounting sleeve in accordance with one or more embodiments of the present invention.

FIG. 6A is a close-up illustration of the outside perimeter of the micro gap roller shade tube assembly showing one or more extrusions 102 for a fabric mounting sleeve in accordance with one or more embodiments of the present invention. As illustrated, the roller shade tube assembly includes one or more extrusions 102 that runs the length of the tube assembly 100 and is configured to hold a fabric mounting sleeve 610.

Figure 6B:
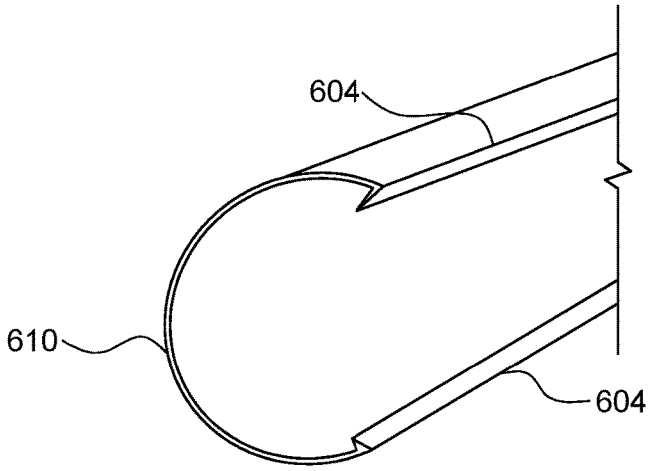
FIG. 6B is a close-up illustration of a fabric mounting sleeve for use with the shade tube of FIG. 6A in accordance with one or more embodiments of the present invention.
Figure 6C:
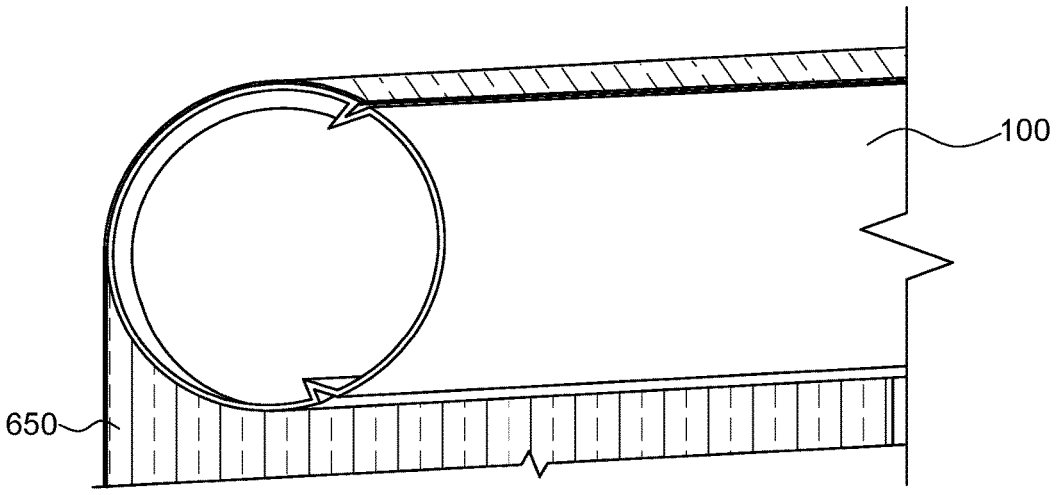
FIG. 6C is a close-up illustration of the fabric mounted with the fabric mounting sleeve to the shade tube assembly in accordance with one or more embodiments of the present invention.

FIG. 6B is a close-up illustration of a fabric mounting sleeve for use with the shade tube of FIG. 6A in accordance with one or more embodiments of the present invention. As illustrated, sleeve 610 comprises a hook end 604 configured to fit into extrusions 102, as illustrated in FIG. 6C. The sleeve could be made of plastic or similar material.

FIG. 6C is a close-up illustration of the fabric 650 mounted with the fabric mounting sleeve 610 to the shade tube assembly 100 in accordance with one or more embodiments of the present invention.

Figure 6D:
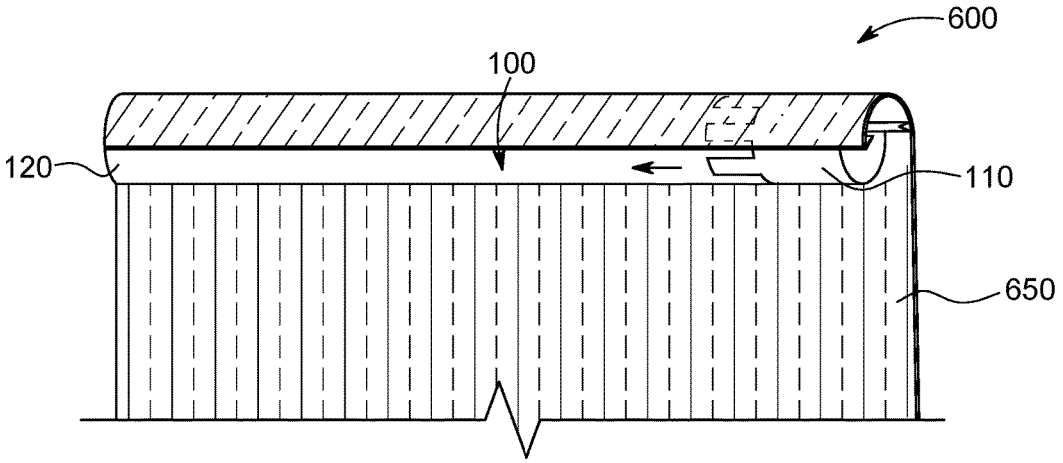
FIG. 6D-E are illustrations of steps of mounting the micro gap roller shade system in accordance with one or more embodiments of the present invention.

The system of the present invention is configured such that assembly could be achieved in the factory floor or assembly line, prior to shipping to customer site. For instance, the fabric could be mounted and secured to the main tube 120 during assembly at the factory. The fabric could be secured using glue or similar type device. The section of the fabric that fits on the auxiliary tube 110 could be left unsecured so that the auxiliary tube could slide easily on the sleeve during installation, as illustrated in FIG. 6D. The arrow on tube 120 shows the direction of compression during installation to the auxiliary side bracket 150.

Figure 6E:
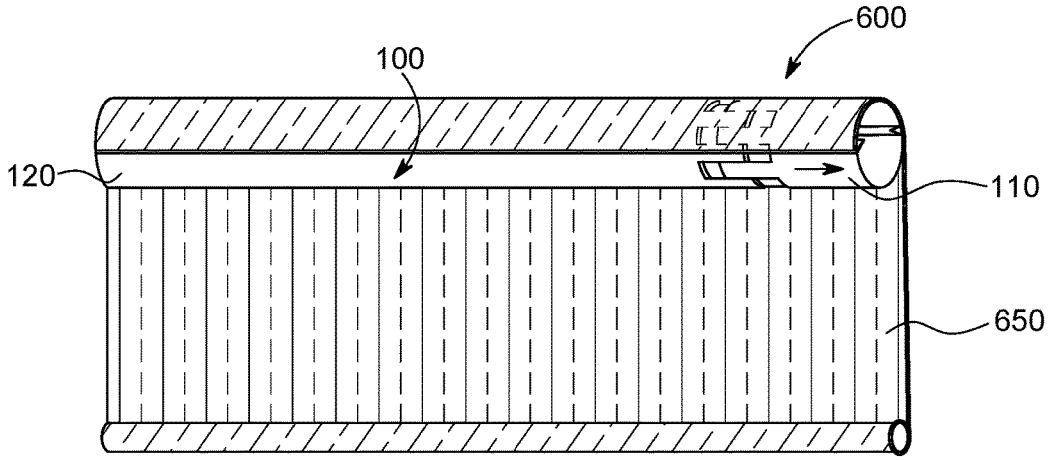

FIG. 6E is an illustration of showing the roller shade assembly and fabric 600 when the compression force is released during installation. By releasing the compression force (see arrow on auxiliary tube), the system almost completely eliminates the gap 704 between the window frame and the shade. The remaining gap is at least 75% less than current systems. For instance, the system allows for a gap as little as one millimeter or less because the only required space (gap) is so that the tube assembly 100 can rotate freely. Of course, the gap could be greater than 1.0 mm, depending on the installation. In one or more embodiments, the gap could be between 1.0 and 5.0 mm.

In one or more embodiments, the system comprises a manual shade assembly. Thus, instead of the motor 170, a spring lift mechanism may be installed in the main housing. Other embodiments may include a manual cord reel type assembly.

FIG. 7 is an illustration of the micro gap roller shade system 600 mounted on a window frame 702 in accordance with one or more embodiments of the present invention. As illustrated, the assembly 700 comprises assembled window shade system 600, which is the tube assembly and the mounted fabric, in window frame 702. With the system of the present invention, the gap 704 between the shade and the window frame 702 is reduced by approximately 75% or more over prior art window shade systems. The micro gap, approximately 1.0 mm, allows for better light control in the room and more privacy. Also, the smaller gap provides for improved temperature control, thereby helping in energy efficiency.

Other benefits include that the shade fabric fits the window better and is symmetrical. The brackets are in recessed cavities thus are not visible. The compressible tube 100 allows for the installer to stand in the center of any length roller shade to effortlessly install a window shade, unlike current systems.

While the invention herein disclosed has been described by means of specific embodiments and applications thereof, numerous modifications and variations could be made thereto by those skilled in the art without departing from the scope of the invention set forth in the claims.

What is claimed is:

1. A roller shade apparatus comprising:

a tubular main housing having a first cavity divided into a proximal lumen and a distal lumen by an internal spring stop, wherein the distal lumen is configured to house an electric motor that is configured to drive the main housing, wherein a distal end of the tubular main housing comprises a first recessed mounting cavity and a proximal end of the tubular main housing comprises a first plurality of interlocking fingers;

a compression spring inside the proximal lumen and abutting against the spring stop;

a tubular auxiliary housing having a distal end with a second plurality of interlocking fingers slidably interlocking with the first plurality of interlocking fingers, wherein a proximal end of the auxiliary housing comprises a second recessed mounting cavity;

an inner guide cylinder having a first end and a second end, wherein said first end is slidably coupled inside said proximal lumen of said main housing and abutting against said compression spring, and wherein said second end is fixedly coupled inside the auxiliary housing;

a main side bracket, wherein the main side bracket substantially fits inside said first recessed mounting cavity; and an auxiliary side bracket, wherein the auxiliary side bracket substantially fits inside said second recessed mounting cavity.

2. The apparatus of claim 1, further comprising said electrical motor.

3. The apparatus of claim 2, wherein the main side bracket is configured with an orifice for coupling electrical power to the motor.

4. The apparatus of claim 1, wherein the main side bracket is configured to be fixedly coupled to the motor.

5. The apparatus of claim 1, wherein a length of said plurality of interlocking fingers defines a compression travel range between the main housing and the auxiliary housing.

6. The apparatus of claim 1, further comprising a fabric coupled to the main housing and the auxiliary housing.

7. The apparatus of claim 1, wherein the main housing and the auxiliary housing include an extrusion from the distal end of the main housing to the proximal end of the auxiliary housing.

8. The apparatus of claim 7, further comprising a sleeve for mounting a fabric to the main housing and the auxiliary housing via said extrusion.

9. A roller shade apparatus comprising:

a roller shade tube assembly comprising:

a tubular main housing having a first cavity divided into a proximal lumen and a distal lumen by an internal spring stop, wherein the tubular main housing comprises a distal end having a first recessed mounting cavity and a proximal end having a first plurality of interlocking fingers, wherein the distal lumen is configured to house an electric motor that is configured to drive the main housing;

a spring inside the proximal lumen and abutting against the spring stop;

a tubular auxiliary housing having a distal end with a second plurality of interlocking fingers slidably interlocking with the first plurality of interlocking fingers, wherein a proximal end of the auxiliary housing comprises a second recessed mounting cavity;

an inner guide cylinder having a first end and a second end, wherein said first end is slidably coupled inside said proximal lumen of said main housing and abutting against said spring, and wherein said second end is fixedly coupled inside the auxiliary housing;

a main side bracket, wherein the main bracket substantially fits inside said first recessed mounting cavity; and an auxiliary side bracket, wherein the auxiliary bracket substantially fits inside said second recessed mounting cavity; and a shade fabric coupled to the roller shade tube assembly.

10. The apparatus of claim 9, further comprising a sleeve for mounting the fabric to the roller shade tube assembly.

11. The apparatus of claim 9, wherein the spring is a compression spring.

12. The apparatus of claim 9, further comprising said electrical motor inside said distal lumen of the main housing.

13. The apparatus of claim 12, wherein the main side bracket comprises an orifice for coupling power to the electrical motor.

14. The apparatus of claim 9, wherein the main side bracket is configured to be fixedly coupled to the motor.

15. A roller shade apparatus comprising:

a tubular main housing having a first cavity divided into a proximal lumen and a distal lumen by an internal spring stop, wherein a proximal end of the main housing comprises a first plurality of fingers;

an electric motor located inside said distal lumen and configured to drive the main housing;

a spring inside the proximal lumen and abutting against the spring stop;

a tubular auxiliary housing having a distal end with a second plurality of fingers configured as complementary to, and slidably interlocking with, the first plurality of fingers;

an inner guide cylinder having a first end and a second end, wherein said first end is slidably coupled inside said proximal lumen of said main housing and abutting against said spring, and wherein said second end is fixedly coupled inside the auxiliary housing;

a main side bracket configured to substantially reside inside a recessed cavity in the distal end of the main housing; and an auxiliary side bracket configured to substantially reside inside a recessed cavity in a proximal end of the auxiliary housing.

16. The apparatus of claim 15, wherein a length of said plurality of interlocking fingers defines a compression travel range between the main housing and the auxiliary housing.

17. The apparatus of claim 15, wherein the main side bracket comprises an orifice for coupling power to the electrical motor.

* * * * *